United States Patent [19]

Labbe

[11] Patent Number: 4,491,138

[45] Date of Patent: Jan. 1, 1985

[54] CIGARETTE MANUFACTURE

[75] Inventor: Francis A. M. Labbe, Neuilly-sur-Seine, France

[73] Assignee: Molins, PLC., London, England

[21] Appl. No.: 457,510

[22] Filed: Jan. 12, 1983

[30] Foreign Application Priority Data

Jan. 13, 1982 [GB] United Kingdom ..... 8200936

[51] Int. Cl.[3] ..... A24C 5/39

[52] U.S. Cl. ..... 131/109 R; 131/110; 131/84 B; 131/909; 406/33

[58] Field of Search ..... 131/84 B, 108, 109 R, 131/109 AB, 110, 909; 406/33, 31, 115, 52, 116; 414/294

[56] References Cited

U.S. PATENT DOCUMENTS

| | | | |
|---|---|---|---|
| 2,983,275 | 5/1961 | Volckers | 406/52 |
| 3,544,167 | 12/1970 | Fuchu et al. | 406/33 |
| 3,614,166 | 10/1971 | Spitz | 406/33 |
| 4,050,741 | 9/1977 | Dickinson | 131/110 |
| 4,118,075 | 10/1978 | Lubbehusen | 406/33 |
| 4,278,365 | 7/1981 | Sandberg | 406/31 |

*Primary Examiner*—V. Millin
*Assistant Examiner*—Harry J. Macey
*Attorney, Agent, or Firm*—Antonelli, Terry & Wands

[57] ABSTRACT

An apparatus for pneumatically feeding tobacco to a number of cigarette making machines having a plurality of conveyors. The conveyors feed tobacco onto a circular feed table where the tobacco is distributed to each of the cigarette machines. The table is arranged to convey the tobacco along a circular path around the vertical central axis of the table. The apparatus further includes a number of suction pipes which are circumferentially spaced with respect to the table and are arranged to pick up tobacco for delivery to respective cigarette making machines. Each cigarette making machine has a hopper for accumulating tobacco including detectors for detecting the quantity of accumulated tobacco. In addition, there is a drive mechanism associated with each pipe for moving each pipe substantially radially with respect to the table to control the rate at which tobacco is picked up from the table. Such control is responsive to the detectors.

9 Claims, 4 Drawing Figures

CIGARETTE MANUFACTURE

This invention is concerned with feeding tobacco to cigarette making machines. Such machines are commonly fed with tobacco pneumatically at spaced intervals in response to demand by the machine. It is preferable, however, to feed the tobacco continuously since it is then possible to use lower air velocities, with consequent reduction in the damage to the tobacco while it is being fed pneumatically; damage tends to occur especially while the tobacco is passing through bends in the pipe. However, it is difficult to feed tobacco at a constant rate which exactly matches the requirement of the cigarette making machine.

According to the present invention, apparatus for feeding tobacco pneumatically to a number of cigarette making machines comprises means for feeding tobacco onto a circular table arranged to convey the tobacco along a circular path around the vertical central axis of the table; a number of pipes which are circumferentially spaced with respect to the table and are arranged to pick up tobacco for delivery to respective cigarette making machines; means for accumulating tobacco at each cigarette making machine, including means for detecting the quantity of accumulated tobacco; and means for moving each pipe substantially radially with respect to the table to control the rate at which tobacco is picked up from the table, such control being responsive to the means for detecting the quantity of tobacco at the respective cigarette making machine.

It is assumed for this purpose that each pipe picks up all or substantially all of the tobacco which passes beneath it on the table. Thus, the radial position of the pipe determines the rate at which tobacco is received by the pipe since the velocity of the tobacco on the table varies according to the radial position, (i.e. the distance of the pipe from the axis of the table). The thickess of the tobacco layer is substantially constant in any given segment of the table swept by a given pipe.

Preferably the tobacco is accumulated at each maker in a downwardly extending channel, the quantity of tobacco being indicated by the height of the column of tobacco in the channel. The capacity of the channel is preferably as small as possible; the minimum value is determined mainly be the range and speed of control of the pick-up pipes over the table, and upon the length of the pipe between the pick-up point and the making machine. In this connection, the channel (or other accumulator) should preferably be capable of absorbing all the tobacco which is being transmitted through the pipe (i.e. is on its way to the making machine) in the event that the making machine stops suddenly while the quantity of tobacco in the channel is at the maximum level normally achieved during operation of the machine; alternatively, part or all of the tobacco in the pipe when the making machine stops may be returned to the source of supply basically in the manner described in British Pat. No. 1,397,727.

This invention is particularly useful in the case of a cigarette making machine which produces discard tobacco (e.g. tobacco removed from the cigarette filler stream by a trimmer) which must be re-used. For that purpose, the discard is preferably fed pneumatically in to the pipe of the corresponding making machine, so as to be combined with the fresh tobacco arriving at the making machine. In such circumstances it is desirable to maintain a continuous delivery of tobacco so that the discard tobacco is always blended with fresh tobacco, as the machine would otherwise at times receive pure discard tobacco which would produce cigarettes of different quality.

An example of a system according to this invention is shown in the accompanying drawings. In these drawings.

Figure 1:
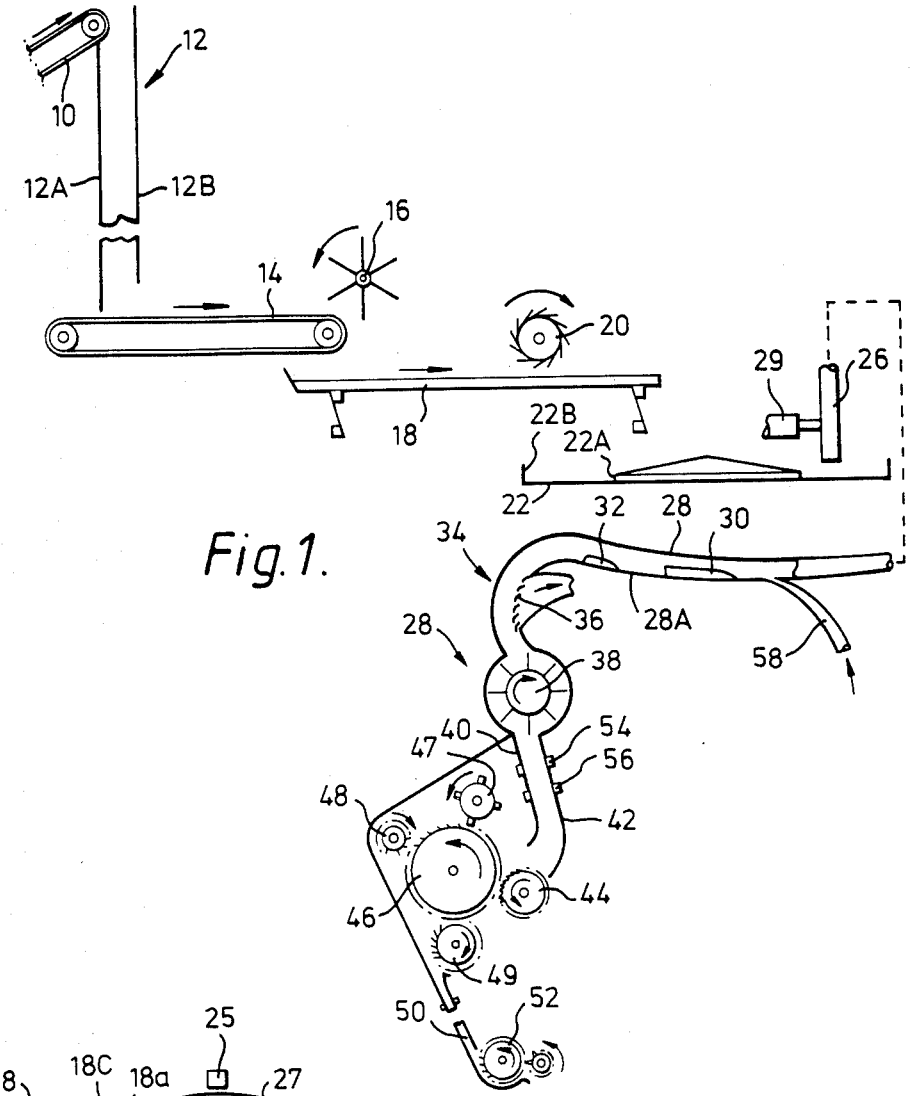
FIG. 1 is a diagrammatic elevation showing tobacco being fed to a circular vibratory feed table and thence to the hopper of a cigarette making machine.

As shown in FIG. 1, tobacco is delivered (e.g. from a conventional tobacco silo) by a conveyor 10 into the upper end of a first downwardly extending channel 12 at a rate such as to maintain a substantially constant height of tobacco in the channel. This channel is formed by substantially parallel walls 12A and 12B which are spaced apart by approximately 100 mm and are approximately 450 mm wide. A carpet of tobacco, also approximately 100 mm in thickness, is conveyed from the lower end of the channel 12 by a conveyor 14. A spiked doffer roller 16 loosens the tobacco as it leaves the conveyor 14 and spreads it along part of the length of a further conveyor 18 which is preferably in the form of a vibratory tray, as shown in the drawings. The velocity at which tobacco is conveyed by the tray 18 is such that the carpet of tobacco formed on the tray is approximately 30 to 35 mm thick.

Any significant lumps of tobacco which are received by the tray 18 tend to be picked up by a spiked selector roller 20 having spikes or pins. The roller 20 rotates at a relatively high speed, e.g. about 400 rpm, such that the spikes tend to open up any lumps of tobacco which are caught by them; the pins are forwardly inclined with respect to radial lines, e.g. by about 30°, so that the tobacco is flung off the pins (this being assisted by the high speed of rotation of the roller) towards the upstream end of the tray 18, rather than being entrained on the roller 20. Alternatively, the roller 20 may be turned around so as to project the opened up lumps of tobacco towards the downstream end of the tray 18.

Thus substantially lump-free tobacco is delivered by the tray 18 on to a circular feed table 22, substantially evenly across the tray (i.e. forming on the tray a carpet of uniform thickness). For that purpose the delivery end of the tray is formed as a curve 18A about a point lying on a radius of the tray which is perpendicular to the longitudinal centre line of the tray, the ends 18B and 18C of the curve 18A being respectively above inner and outer circular walls 22A and 22B defining the operative area of the table.

The table 22 preferably conveys tobacco by means of a rotary vibratory action about the vertical axis 22C of the table, basically in the manner described in British patent specification No. 1520424. It is arranged to feed tobacco in a clockwise direction, as indicated by the arrow 24.

Figure 2:
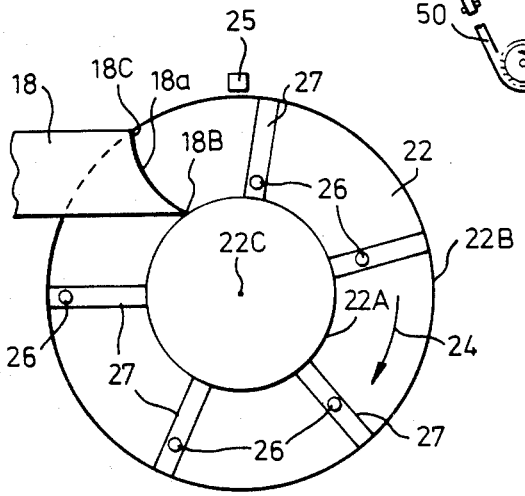
FIG. 2 is a diagrammatic plan view of the feed table shown in FIG. 1.

A number of downwardly extending pipes 26 movable along radial tracks 27 are arranged to suck up tobacco from the feed table for delivery to respective cigarette making machines of which part of one (on a larger scale) is shown diagrammatically in FIG. 1. FIG. 2 shows five circumferentially spaced pipes 26 for delivering tobacco to five cigarette making machines; however, that is only one example and it should be understood that there may be more or fewer pipes and making machines.

The part 28 of each cigarette making machine is constructed as follows.

Tobacco conveyed pneumatically through the pipe 26 shown in FIG. 1 enters a duct 28 which increases progressively in width (at right angles to the paper) to allow the tobacco to be spread into a loose carpet of, for example, about 60 cm width. This spreading is achieved by a primary splitter member 30 which is followed by secondary splitter members 32, the splitter members all being mounted on the lower wall 28A of the duct onto which the tobacco is urged by centrifugal force owing to the curvature of the duct. After leaving the duct 28, the tobacco passes through an air separator 34 from which air is drawn through a louvre 36 by a suction fan (not shown). A rotary seal 38 carries the tobacco further downwards without allowing any significant reverse flow of air having regard to the fact that there is suction pressure above the rotary seal 38 and substantially atmospheric pressure below the seal.

The duct 28 and other associated parts may correspond to any one of the examples described in our British patent application No. 2096877.

On leaving the rotary seal 38, the tobacco enters a downwardly extending channel formed by substantially parallel walls 40 and 42. A roller 44 (which may be ribbed or knurled) feeds tobacco from the channel at a controlled and preferably variable rate towards a spiked drum 46 rotating at a constant speed. A doffer roller 47 knocks back any lumps of tobacco carried forward on the drum 46, and the remaining tobacco is removed from the drum 46 by a picker roller 48. Apart from any lumps which are picked up by a spiked roller 49, the tobacco enters a further channel 50 from which it is fed continuously by a further spiked roller 52 towards a part of the machine in which the loose carpet of tobacco is formed into a cigarette filler stream in any conventional manner.

The height of the tobacco column in the channel 40, 42 is monitored by two photoelectric or other detectors 54 and 56 which determine the rate at which tobacco is delivered from the feed table. For example, when the level of tobacco reaches or exceeds the height of the upper detector 54, indicating that tobacco is arriving at an excessive rate, the corresponding pipe 26 is automatically moved radially towards the centre of the feed table by one increment. After a predetermined interval of time, if the level of the tobacco in the channel 40, 42 still lies above the detector 54, the corresponding pipe 26 is automatically moved radially inwards by a further increment, and so on until the height of tobacco in the channel 40, 42 falls below the detector 54. When the tobacco level falls below the lower detector 56, the corresponding pipe 26 is moved radially outwards by one increment; if the level of tobacco still lies below the detector 56 after a predetermined time interval, the pipe 26 is automatically moved radially outwards by a further increment, and so on until the level of tobacco rises above the detector 56.

It will be seen that successive pipes 26 are shown in FIG. 2 at increasing distances from the axis of the feed table; that is to say, the distance from the centre of the table increases with increasing distance from the tobacco delivery position below the end 18A of the vibratory tray 18. The positions of the pipes shown in FIG. 2 approximate to the mean positions while all the cigarette making machines are in operation. The inlets of the pipes 26 may all be of similar cross-section, but the pipes receive tobacco at substantially the same rate while in their mean positions for the following reason: immediately downstream of the tobacco delivery position (below the tray end 18A) the thickness of the layer of tobacco on the tray is at a maximum, and the thickness reduces progressively as more and more tobacco is sucked up by successive pipes 26. The vibratory action of the table ensures that the tobacco on the table at any circumferential position spreads substantially evenly radially across the table.

If any of the cigarette making machines stops, and therefore requires no further delivery of tobacco, the pipes 26 which lie downstream of the pipe for the inoperative maker may be arranged to move radially inwards automatically, so that the first pipe after the inoperative pipe then occupies the mean radial position of inoperative pipe, and so on. Thus if, for example, the first three pipes are suddenly no longer required to receive tobacco (because their corresponding makers have stopped), the other two pipes may be moved automatically immediately into the mean positions occupied by the first two pipes; otherwise they would temporarily receive far too much tobacco (because of the suddenly increased thickness of the tobacco layer on the table).

Movement of the pipes 26 may be achieved by any convenient servo devices, e.g. pneumatic cylinders 29.

In order to lift the tobacco towards the inlet to each pipe, as described in the above-mentioned patent specification, there may be a ramp immediately upstream of each pipe. More specifically, there may be a row of radially spaced ramps immediately upstream of each pipe, and each pipe may be moved step-wise from one ramp to another to achieve the appropriate change of tobacco flow rate as described above.

Discard tobacco is returned by a pipe 58 to the corresponding pipe 26 upstream of the tobacco-spreading duct 28 so that it is blended with fresh tobacco.

The rate at which tobacco is fed onto the table 22 is controlled automatically by varying the speed of the conveyor 14. This control may be in response to the thickness of the layer of tobacco on the tray measured, for example, immediately upstream of the first of the pipes 26 (where the thickness of the layer is greatest). Such measurement may be made by a stationary photoelectric device 25 scanning horizontally across the table, or by a sensor plate resting lightly on the tobacco. In addition, the speed of the conveyor 14 is preferably changed automatically in response to a change in the number of cigarette making machines which are in operation.

Figure 3:
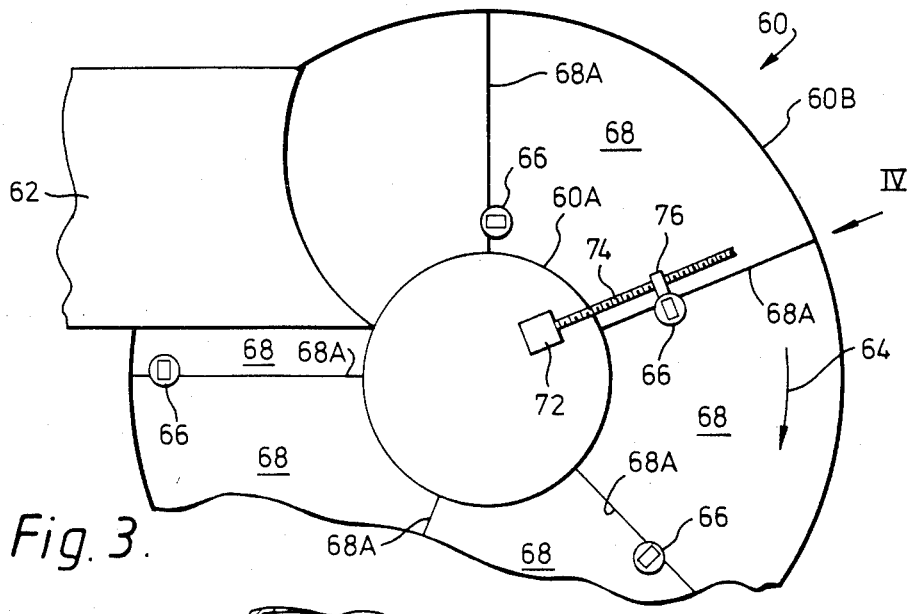
FIG. 3 is a plan view of a modified feed table.

FIG. 3 shows a feed table 60 having inner and outer circular walls 60A and 60B defining the boundaries of an annular conveying surface through which tobacco is conveyed with a rotary vibratory action. The tobacco is delivered onto the feed table by a vibratory conveyor 62 and is conveyed around the table in the direction of the arrow 64.

As in FIG. 2, there are five pick-up pipes 66, each being mounted above the edge 68A of a ramp 68, each edge 68A being radial with respect to the table. Tobacco 70 (see FIG. 4) is conveyed up the successive ramps by the rotary vibratory motion of the table, and each pipe 66 is arranged to pick up tobacco as it falls off the edge 68A of the corresponding ramp. This ensures that substantially all the tobacco passing beneath each pipe (while the cigarette making machine fed by that pipe is in operation) is sucked up by the pipe; i.e. that no tobacco shorts are left on the table.

In FIG. 3 the five pipes 66 are shown spread over an arc of 270°. They may instead be spread at uniform intervals around the entire table.

Each pipe is radially adjustable by means of a motor 72 driving a screw 74 engaging a nut 76 on the pipe, only one such arrangement being shown in FIG. 3. Additional guides may be provided to support each pipe for radial movement with respect to the table.

The table is mounted on a number of circumferentially spaced leaf springs 78 which are inclined to the vertical and are secured respectively to the table and to a support structure 80. A reciprocating drive rod 82 is tangential to the table so as to cause the table to oscillate about its vertical axis. Because of the inclination of the leaf springs 78, the oscillations of the table result in the tobacco being conveyed in the direction of the arrow 64 in FIG. 3 and from right to left in FIG. 4.

As already mentioned, the table is or may be basically as described in British patent specification No. 1520424.

Each pipe 66 has an entry portion 66A which is circular in cross-section at its upper end and changes progressively towards a rectangular cross-section at its lower end, the actual lower extremity 66B of each pipe being cut off at an inclination to the horizontal of approximately 34°. By way of example, the main part of the pipe may be of 100 mm diameter, and the cross-section at the lower end of the entry portion 66B may be approximately 75 mm×60 mm.

Further by way of example, the external diameter of the table 60 may be approximately 1700 mm, the internal diameter being 600 mm. In order to supply sufficient tobacco for five cigarette making machines operating at 8000 cigarettes per minute, the maximum depth of the carpet of tobacco on the table may be approximately 75 mm.

Figure 4:
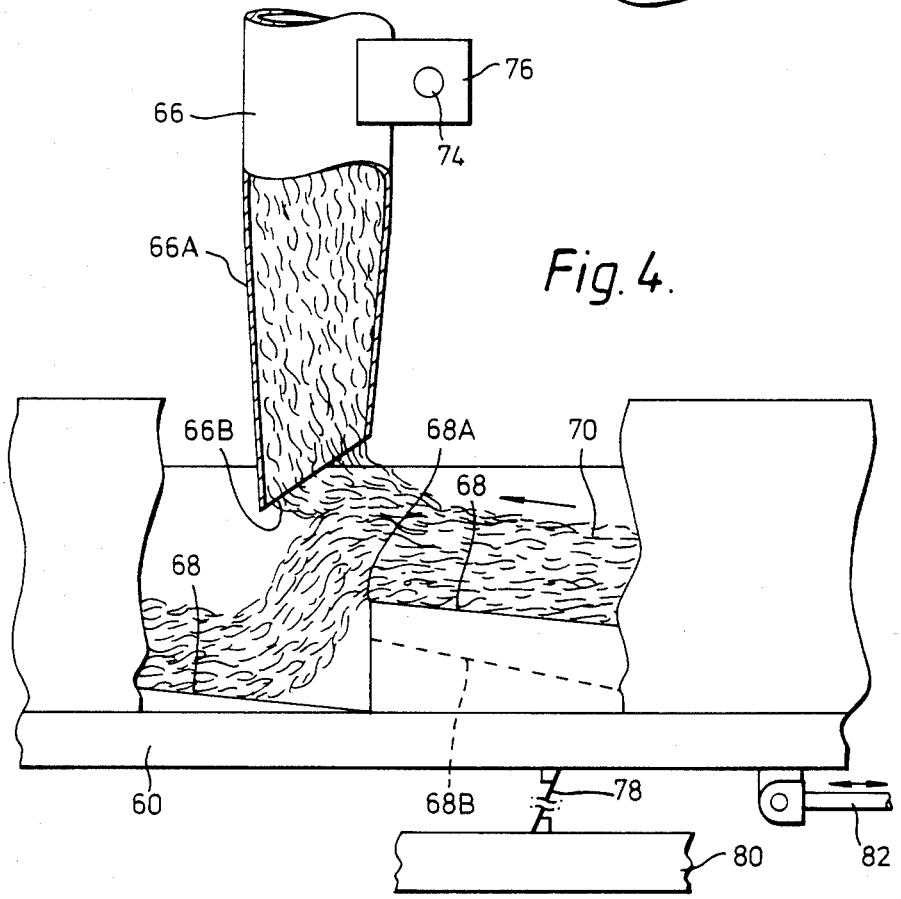
FIG. 4 is a view of part of the feed table shown in FIG. 3, taken in the direction of the arrow IV.

In the construction shown in FIGS. 3 and 4, the tobacco-conveying surface of the table is formed by a succession of ramps 68. That is to say, each ramp commences immediately below the delivery edge 68A of the preceding ramp. FIG. 4 shows the downstream end of one ramp and the commencement of the next ramp.

The upper tobacco-conveying surfaces of the table are preferably rough so as to convey the tobacco positively. For example, the table may be coated with a rough-finished material. A suitable example is the conveyor material made by LSP - Ammeraal which comprises a woven fibre base which is coated with rough-caste PVC (polyvinyl chloride). Alternatively, carborundum-coated sheet material may be used to cover the surfaces of the table.

As an alternative, especially in the case of a larger table used to supply more cigarette making machines, each of the ramps may be more restricted in its circumferential dimensions, there being flat or substantially flat surfaces between successive ramps. Each ramp may in that case have a steeper angle, and in order to assist the conveyance of tobacco each ramp may have a serated surface with the serations extending substantially radially with respect to the table.

The rotary vibratory action of the table tends to impart not only a circumferential motion to the tobacco, but also a slight component of motion away from the axis of the table. This is preferably compensated by sloping the tobacco-conveying surfaces downwards the centre of the table. In the construction shown in FIGS. 3 and 4, this is achieved by virtue of the fact that each ramp rises more steeply towards the outer perimeter of the table than it does closer to the centre of the table. The dotted line 68B in FIG. 4 shows the upper surface of the ramp in the region adjacent to the inner wall 60A of the table. By way of specific example, the edge 68A of the ramp may comprise a straight line which is slightly inclined to the horizontal, being respectively 75 mm and 50 mm above the base of the table at its outer and inner ends. The screw 74 by which the pipe position is adjusted may be similarly inclined to the horizontal.

Each of the pipes 66 is controlled by its corresponding motor 72 in response to the height of the tobacco in the channel 40, 42 of the corresponding cigarette making machine, or by some other means indicative of the tobacco feed requirement of the corresponding cigarette making machine. The motor 72 may provide a continuous adjustment of the radial position of the pipe 66, or may move the pipe in predetermined steps as described previously; in the latter case, the motor may comprise an electrical stepper motor.

When a particular pipe 66 is no longer required to pick up tobacco from the table, because the corresponding cigarette making machine has stopped, the pipe may be moved radially inwards or outwards so as to be entirely clear of the tobacco on the table. Alternatively, each pipe may include a pivoted flap which is opened automatically by an actuator to let in air and thus prevent tobacco being drawn up from the table.

I claim:

1. Apparatus for feeding tobacco pneumatically to a number of cigarette making machines, comprising means for feeding tobacco onto a circular table arranged to convey the tobacco along a circular path around the vertical central axis of the table; a number of pipes which are circumferentially spaced with respect to the table and are arranged to pick up tobacco for delivery to respective cigarette making machines; means for accumulating tobacco at each cigarette making machine, including means for detecting the quantity of accumulated tobacco; and means for moving each pipe substantially radially with respect to the table to control the rate at which tobacco is picked up from the table, such control being responsive to the means for detecting the quantity of tobacco at the respective cigarette making machine.

2. Apparatus according to claim 1, including a detector for detecting the thickness of the tobacco on the table and arranged to control the delivery of tobacco onto the table so as to maintain a substantially constant thickness of tobacco at the detector.

3. Apparatus according to claim 2, in which the tobacco delivery means includes a column from which tobacco is fed at a variable rate by a feed conveyor in response to the thickness of the carpet detected on the feed table.

4. Apparatus according to claim 1, in which the pipe leading to each cigarette making machine includes an inlet through which discard tobacco from the cigarette making machine can be admitted to blend with fresh tobacco delivered through the pipe from the feed table.

5. Apparatus according to claim 1, in which the means for moving each pipe radially with respect to the feed table is arranged to move the pipe in steps, the direction of each step being determined by a signal from the corresponding cigarette making machine indicative of whether the accumulated tobacco is above or below the required level or range of levels.

6. Apparatus according to claim 1, in which the feed table has a plurality of ramps arranged to lift the tobacco towards the pipes, each pipe being positioned so that it sucks up tobacco below it as the tobacco falls over the edge of one of the ramps.

7. Apparatus according to claim 1 in which the means for accumulating tobacco at each making machine comprises substantially parallel downwardly extending walls defining a channel for forming a column of tobacco therein, the detecting means comprising detectors responsive to the height of tobacco in the channel.

8. Apparatus according to claim 7 including a duct portion through which the tobacco is arranged to pass before entering the channel and which is arranged to spread the tobacco into a loose carpet, the channel having a width, corresponding to the width of the carpet, which is considerably greater than its thickness.

9. Apparatus according to claim 8, including an air separator for extracting air from the tobacco prior to entry of the tobacco into the channel.

* * * * *